US005855498A

United States Patent [19]

Spector

[11] Patent Number: 5,855,498

[45] Date of Patent: Jan. 5, 1999

[54] PILLOW-STUFFED FLOATING DEVICE

[76] Inventor: Donald Spector, 380 Mountain Rd., Union City, N.J. 07080

[21] Appl. No.: 852,241

[22] Filed: May 6, 1997

[51] Int. Cl.[6] ..... B63C 9/08

[52] U.S. Cl. ..... 441/88; 441/125; 441/129

[58] Field of Search ..... 441/129, 125, 441/127, 88, 80, 117; 383/63; 5/490

[56] References Cited

U.S. PATENT DOCUMENTS

| | | | |
|---|---|---|---|
| 1,542,561 | 6/1925 | Laskin et al. | 5/490 |
| 2,814,056 | 11/1957 | Farber | 441/117 |
| 3,121,886 | 2/1964 | Seymour | 441/129 |
| 4,006,764 | 2/1977 | Yamamoto et al. | 383/63 |
| 4,668,201 | 5/1987 | Stark | 441/88 |
| 4,768,247 | 9/1988 | Beier | 5/490 |

*Primary Examiner*—Sherman Basinger
*Attorney, Agent, or Firm*—Michael Ebert

[57] ABSTRACT

A flotation device useable as a life-preserver and a water toy, the device including a casing formed of water-impermeable synthetic plastic film material shaped to define a pocket for receiving a conventional pillow having a compressible filler. The pocket is provided with a closable inlet which when closed, hermetically seals the pillow-stuffed casing to provide a compressible yet buoyant life-preserver. The casing may be die cut to assume the contours of a humanoid or animal-like figure whereby the floatation device then functions as a water toy.

8 Claims, 2 Drawing Sheets

PILLOW-STUFFED FLOATING DEVICE

BACKGROUND OF THE INVENTION

1. Field of Invention

This invention relates generally to flotation devices useable in swimming pools, lakes and in other bodies of water suitable for bathers and swimmers, and more particularly to a flotation device created by a conventional pillow stuffed into the pocket of a synthetic plastic film casing.

2. Status of Prior Art

A life-preserver is a flotation device adopted to keep its user afloat in water. While many flotation devices are formed of inflatable rubber or plastic film material, these have the disadvantage of being rendered useless should the inflatable be punctured, or should its air inlet valve become defective. Moreover, with a conventional mouth-inflatable flotation device, it takes a fairly long time and some effort to inflate the device.

Hence a preferred form of flotation device or life-preserver is one whose buoyancy depends on a fibrous stuffing, such as kapok. Kapok is a silk cotton used for stuffing cushions and pillows as well as life-preservers. The advantage of a kapok-stuffed buoyancy device is that its buoyancy will not be impaired should the device be punctured. However a kapok-stuffed life-preserver, unlike one that is inflatable, cannot be deflated and stored in a flat, compact state.

The concern of the present invention is with the needs of families with children that travel by car either on a vacation trip or for any other reason. In the course of such travel, there are stopovers at motels and other accommodations having swimming facilities, such as a pool or a nearby lake. It is customary when a family makes use of a pool or lake to provide at least one flotation device that members of the family, when necessary, can hold onto or play with as a water toy.

In widespread use are inflatable flotation devices fabricated of synthetic plastic film material molded or die cut to resemble an animal-like or humanoid figure. A buoyant inflatable device of this type functions not only as a water toy, but also as a life-preserver. The advantage of such inflatable flotation devices is that they may be deflated and flattened out when not in use and then folded into a compact form. Thus a traveling family can store folded flotation devices in the trunk of the family vehicle. However as previously noted, inflatable flotation devices cease to be effective should there be a loss of air due to a puncture or tear in the plastic, or because of a defective valve.

And while kapok-filled flotation devices provide a high measure of protection in water, such devices cannot be deflated and reduced in size. In a family vehicle on a vacation trip in which the trunk of the car is crowded with articles of clothing and many other items the family needs to take along, little room is available for large flotation devices.

Since in a flotation device in accordance with the invention, use is made of a conventional pillow, of prior art interest in the 1987 Spector U.S. Pat. No. 4,670,924 entitled "Transformable Pillow." This patent discloses a dual-function pillow which is transformable into a figurative form or character. In its normal mode, the pillow serves as a comfortable head rest, while in its transformed mode it functions as a plaything. The pillow which has a soft and compressible body includes a rectangular bag or outer case whose face has applied thereto a two-dimensional figure or character. The bag or case is provided with one or more transversely-placed draw strings which when tightened then act to constrict the pillow and to thereby impart contours thereto to define a main head portion and at least one secondary portion to create a three-dimensional form.

SUMMARY OF INVENTION

In view of the foregoing, the main object of this invention is to provide a flotation device useable as a life-preserver or as a water toy, the device being constituted by a plastic film casing having a conventional pillow stuffed therein.

A significant advantage of a device in accordance with the invention is that the plastic film casing which is separable from the pillow may be folded and stored in a compact form in the trunk of a vehicle, or elsewhere, whereas the pillow need not be stored. When a need arises for the flotation device at a particular site, say at the pool of a motel to assemble the flotation device, the user then makes use of whatever pillow is available in the room in the motel occupied by the user.

More particularly, an object of this invention is to provide a flotation device formed of a synthetic plastic film casing and a compressible pillow stuffed therein, the casing being shaped to assume the playful form of an animal-like or humanoid figure whereby the flotation device also functions as a water toy.

Briefly stated, these objects are attained by a flotation device useable as a life-preserver and a water toy, the device includes a casing formed of water-impermeable synthetic plastic film material shaped to define a pocket for receiving a conventional pillow having a compressible filler.

The pocket is provided with a closable inlet which when closed, hermetically seals the pillow-stuffed casing to provide a compressible yet buoyant life-preserver. The casing may be die cut to assume the contours of a humanoid or animal-like figure whereby the floatation device then functions as a water toy.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

First Embodiment

Figure 1:
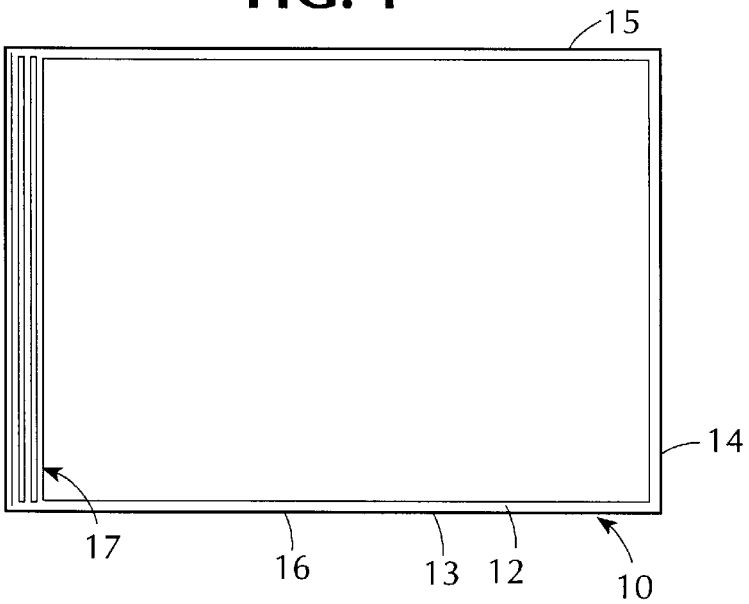
FIG. 1 is a top view of the synthetic plastic film casing included in a pillow-stuffed flotation device in accordance with the invention.
Figure 2:
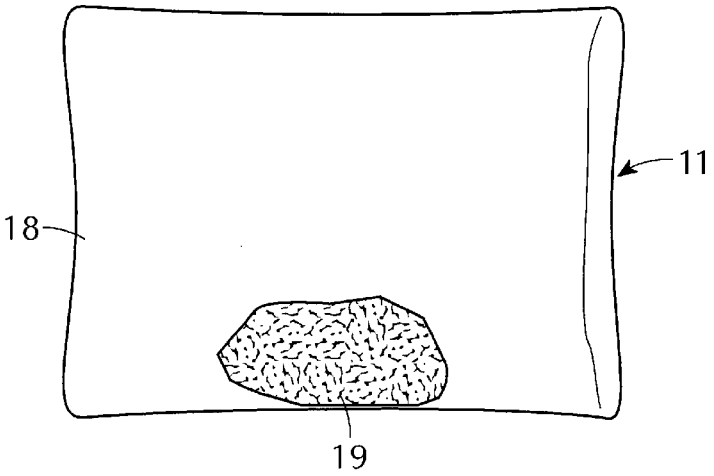
FIG. 2 is a perspective view of the pillow.
Figure 3:
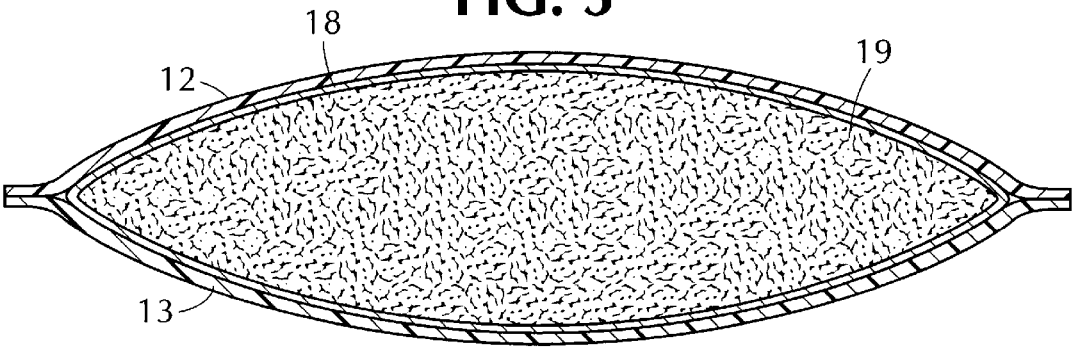
FIG. 3 is a transverse section taken through the flotation device.

A flotation device in accordance with the invention is constituted by a plastic film casing 10, separately shown in FIG. 1, and a conventional pillow 11, separately shown in FIG. 2. When the flotation device is assembled, as shown in FIG. 3, then pillow 11 is stuffed in casing 10 and hermetically sealed therein so that water cannot soak the pillow.

Casing 10 which is generally rectangular, is dimensioned to snugly accommodate a pillow of a standard size. Hence the dimensions of plastic film casing 10 are similar to those of a conventional fabric pillow case.

Casing 10 is formed of two superposed thin sheets 12 and 13 of synthetic thermoplastic film material of high tensile strength, such as biaxially-oriented PVC or polyethylene, each sheet having a 3 or 4 mil thickness. The superposed sheets are marginally sealed together by thermal or ultrasonic bonding along one end margin 14 and the opposing long side margins 15 and 16, the other end margin being unsealed.

Figure 4:
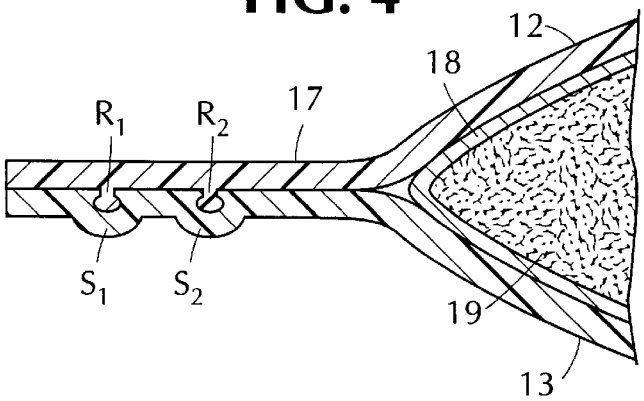
FIG. 4 is a sectional view of the double-zip closure of the casing.

The casing marginally sealed at one end and along both sides defines a pocket for accommodating pillow 11. This pocket has an inlet at its unbonded inlet end which is hermetically sealed by a double zip closure 17. Closure 17 is formed, as shown in FIG. 4, by a pair of parallel plastic ridges $R_1$ and $R_2$ which are pressed into parallel, dilatable plastic sockets $S_1$ and $S_2$ and are engaged thereby. The casing inlet is then being hermetically sealed.

A conventional pillow normally acts as a support for the head of a reclining individual. A pillow usually takes the form of a rectangular fabric bag filled with feathers, down or kapok (cotton silk). Pillow 11 shown in the figures is constituted by a fabric bag 18 and a compressible filler 19.

A pillow is normally provided with a removable pillow case of linen or cotton. This case protects the pillow from dirt and is easily laundered. But a pillow case is not water impermeable, and a conventional pillow, even if filled with kapok, is not useable as a flotation device.

Figure 5:
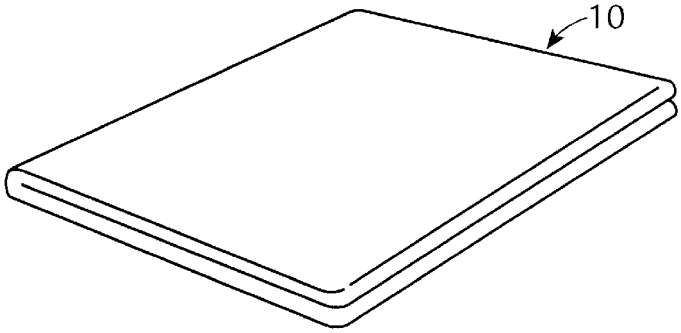
FIG. 5 shows the film casing in a folded compact form.

But when pillow 11 is stuffed into a water-impermeable plastic film casing 10 and is hermetically sealed therein, this assembly then functions as a flotation device. This water flotation device is brought into existence only when a need arises therefor. Thus FIG. 5 shows film casing 10 in a compact, folded state. In this state, the casing may be carried in luggage or stored in the trunk of a vehicle.

When a user arrives at a motel or other accommodation and occupies a room having pillows, and the user wishes to make use of a pool or lake adjacent this accommodation, the user unfolds the casing and stuffs a pillow therein to create a flotation device. The pillow is hermetically sealed in the casing and does not get wet. After the pillow has served its purpose, it is taken out of the casing and returned to the room. Because the flotation device includes a compressible pillow, it may also be used as a beach pillow, for the plastic casing is impermeable to sand as well as water, and the pillow encased therein is protected from the sand.

Second Embodiment

To provide a flotation device that serves as a playful water toy and is not strictly utilitarian in appearance, the casing can be contoured to assume any animal-like or humanoid form.

Figure 6:
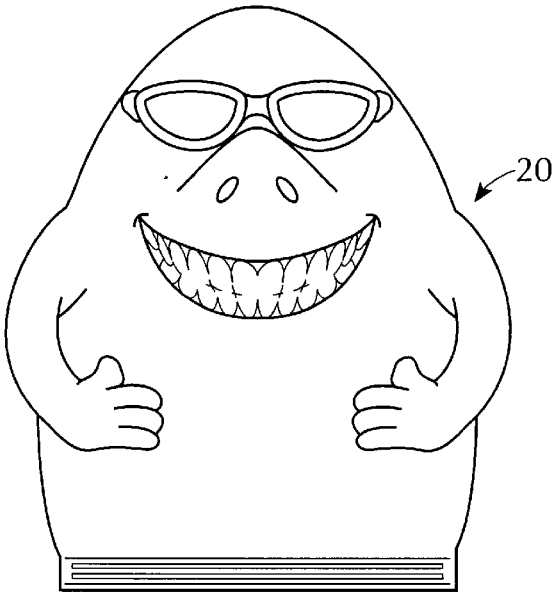
FIG. 6 shows a modified form of casing to produce a water toy.

Thus plastic film casing 20 shown in FIG. 6 is formed as is the casing in FIG. 1 of two superposed sheets of synthetic plastic film material, which sheets are marginally sealed to define a pocket having an inlet provided with a closure. But the sheets which form casing 20 are die cut to define the contours of an animal-like or humanoid figure. Thus the figure may have a head, a torso and simulated appendages, the sheets being printed to define the features of the head and other details appropriate to the figure.

Contoured casing 20 is only somewhat rectangular and therefore does not match the rectangular form of the pillow as in the case of casing 10 in FIG. 1. But the dimensions of casing 20 are such as to loosely accommodate pillow 11. The resultant air spaces between the casing and the pillow stuffed therein do not impair the buoyancy of the flotation device.

While there has been shown preferred embodiments of a pillow-stuffed flotation device in accordance with the invention, it will be appreciated that many changes and modifications may be made therein without, however, departing from the essential spirit thereof.

I claim:

1. A flotation device for use in a body of water adjacent an accommodation having a conventional pillow available to a user of the device whereby the user can convert the pillow to a life preserver; said device comprising:

A. a conventional pillow formed of a fabric bag enclosing a compressible filler; and B. a casing for accommodating the pillow formed of synthetic plastic water-impermeable film material defining a pocket having an inlet to admit the pillow, said inlet being provided with a manually-operated closure which when closed then hermetically seals the pillow within the casing to create a buoyant life preserver.

2. A device as set forth in claim 1, in which the casing is formed of two superposed sheets of said film material marginally sealed at one end and along opposing sides of the sheets, the other end being unsealed to form said inlet, said inlet closure being a double-zip closure in which one sheet is provided with a pair of parallel plastic ridges which are pressable into a pair of parallel dilatable plastic sockets in the other sheet.

3. A device as set forth in claim 2, in which the film material is thermoplastic, and in which the marginal sealing is effected by thermal bonding.

4. A device as set forth in claim 3, in which the sheets are formed of PVC and are biaxially oriented.

5. A device as set forth in claim 2, in which the sheets each have a thickness not exceeding about 4 mils.

6. A device as set forth in claim 1 in which the casing has a generally rectangular form and the pillow is snugly received in the pocket defined by the casing.

7. A device as set forth in claim 1, in which the casing is contoured to define an animal-like or humanoid figure, and the pillow is loosely received therein.

8. A device as set forth in claim 7, in which the sheets are printed to define features of the figure.

* * * * *